US007137537B2

(12) United States Patent
Rueschhoff et al.

(10) Patent No.: US 7,137,537 B2
(45) Date of Patent: Nov. 21, 2006

(54) DISPENSE FOR DELIVERING SUBSTANCES ONTO AND INTO LIQUIDS

(75) Inventors: Kenneth J. Rueschhoff, Wildwood, MO (US); James P. McBroom, House Springs, MO (US); Gregory S. Ludbrook, Kirkwood, MO (US); Joseph C. Lott, DesPeres, MO (US); Richard A. Berger, Troy, MO (US)

(73) Assignee: Clayton Corporation, Fenton, MO (US)

( * ) Notice: Subject to any disclaimer, the term of this patent is extended or adjusted under 35 U.S.C. 154(b) by 0 days.

(21) Appl. No.: 11/174,012

(22) Filed: Jul. 1, 2005

(65) Prior Publication Data

US 2006/0006201 A1 Jan. 12, 2006

Related U.S. Application Data

(60) Provisional application No. 60/615,453, filed on Oct. 1, 2004, provisional application No. 60/585,417, filed on Jul. 2, 2004.

(51) Int. Cl.
*B65D 83/00* (2006.01)

(52) U.S. Cl. ..... 222/402.13; 222/402.15; 222/402.21; 222/556

(58) Field of Classification Search ..... 222/402.13, 222/402.14, 402.15, 402.1, 548, 402.21, 222/182, 635, 527–529, 537, 541.9, 560, 222/556, 402.12, 533–535

See application file for complete search history.

(56) References Cited

U.S. PATENT DOCUMENTS

| | | | | |
|---|---|---|---|---|
| 3,169,673 | A * | 2/1965 | Focht | 222/182 |
| 3,204,644 | A * | 9/1965 | McDougall-Kaley | 132/212 |
| 4,067,482 | A * | 1/1978 | Vogel et al. | 222/153.11 |
| 5,501,375 | A * | 3/1996 | Nilson | 222/402.13 |
| 5,915,599 | A * | 6/1999 | Takahashi | 222/402.13 |
| 2003/0168476 | A1 * | 9/2003 | Sanchez | 222/321.7 |

* cited by examiner

*Primary Examiner*—Frederick C. Nicolas
(74) *Attorney, Agent, or Firm*—Harness, Dickey & Pierce, P.L.C.

(57) ABSTRACT

The inventive dispenser comprises a cap and dispenser tube assembly for delivering a foamed product below the surface of a liquid through the dispenser tube. The dispenser tube pivots between a dispensing position and a non-dispensing stowed position, which allows for convenient cleaning of the dispensing tube. The cap further comprises a removable portion between a first and second section of the cap that restricts movement to prevent operation of the dispensing valve until the removable portion is detached by the consumer. The cap also includes a tamper resistant removable pull tab for securing the dispenser tube in the stowed position until the pull tab is detached by the consumer.

23 Claims, 5 Drawing Sheets

DISPENSE FOR DELIVERING SUBSTANCES ONTO AND INTO LIQUIDS

CROSS-REFERENCE TO RELATED APPLICATIONS

This application claims the benefit of U.S. Provisional Application No. 60/615,453, filed Oct. 1, 2004 and U.S. Provisional Application No. 60/585,417, filed Jul. 2, 2004. The disclosures of the above applications are incorporated herein by reference.

BACKGROUND OF THE INVENTION

This invention relates to a dispenser for aerosol products, and in particular to a dispenser capable of delivering a substance onto a surface and or into a liquid, for example for frothing beverages.

Aerosol containers which dispense food products such as whipped cream have found wide application in the food industry. Food products are often packaged in aerosol cans with a pressurizing agent such as nitrous oxide, which acts as a propellant for dispensing a liquid food product. These aerosol cans include a dispensing valve that may be employed in dispensing a foam-forming liquid as a foam. Such valves may be intermittently operated to dispense small amounts of the product as needed. A problem with these valves is that the product dispensing nozzle or tube does not conveniently provide for delivery into or onto liquids, as would be desirable in making popular "frothed" beverages, such as lattes. For example it would be desirable to dispense a foamed substance, such as whipped cream, onto, and more preferably into a beverage to make a latte. Another problem with many current dispensers is that they can be difficult to clean, particularly after immersion into a beverage.

SUMMARY OF THE INVENTION

A preferred embodiment of the present invention is an aerosol dispenser comprising a cap and a dispenser tube assembly for delivering the contents of an aerosol can. The dispenser tube is preferably pivotally mounted on the cap to pivot between a dispensing position, in which the tip can be placed adjacent to a surface or onto or into a liquid, and a stowed non-operating position between uses.

In the preferred embodiment, the dispenser tube may also be pivoted to a position between the stowed and dispensing positions in which both ends of the tube are accessible for easy cleaning of the dispenser after use.

In the preferred embodiment the dispenser cap is adapted to be secured to an aerosol container and connect to the aerosol dispensing valve thereon. The dispenser cap is preferably configured to resist unintentional movement or operation of the dispensing valve. In the preferred embodiment the dispenser cap has a removable portion that blocks operation of the cap until it is removed.

More specifically, the cap of the preferred embodiment comprises a first section that may be secured to an aerosol container over a dispensing valve and a second section that may be pivoted relative to the first section to operate the dispensing valve on the aerosol container. A removable portion between the first and second sections interferes with relative movement of the sections until it is removed, preventing inadvertent operation and providing an indication after the product has been used.

The cap can further comprise a recess for mounting a pivoting dispensing tube that pivots between a first stowed position and a second dispensing position. The dispensing tube comprises a passage that, when the dispensing tube is pivoted to the dispensing position, is in communication with the dispensing valve through an opening in the cap. A push tab on the second section of the cap may be pushed to move the second section (after the removable portion is detached), which movement operates the dispensing valve to deliver a product through the passage in the dispenser tube. In the preferred embodiment the dispenser tube interferes with access to the push tab when the dispenser tube is its stowed position. However, when the dispenser tube is pivoted to the dispensing position, the dispenser tube extends away from the cap and may be placed adjacent to a surface or onto or into a liquid to dispense the contents of the aerosol container. Preferably, in a position between the dispensing and stowed positions, the ends of the passage through the dispenser tube are open or exposed to allow the passage to be conveniently cleaned.

A tamper resistant removable pull tab can be provided for securing the dispenser tube in the stowed position prior to use by the end consumer. The removable tab restricts pivoting movement of the dispenser tube away from its initially stowed position, until the removable pull tab is detached by the consumer. The absence of the pull tab from the product provides a tamper indication that enables the vendor or consumer to identify possible tampering.

Various embodiments of this invention provide an improved dispenser for dispensing the contents of an aerosol container onto a surface, or into a liquid such as a beverage. Some embodiments can include a removable portion to resist inadvertent operation, and indicate when the product had been tampered with. Some embodiments can include a removable tab to secure the dispenser tube to likewise resist inadvertent operation, and indicate when the product has been tampered with. Some embodiments can be configured so that the ends of the dispensing tube can be exposed for convenient cleaning.

These and other features and advantages will be in part apparent, and in part pointed out herein after.

BRIEF DESCRIPTION OF THE DRAWING

Corresponding reference numerals indicate corresponding parts throughout the several views of the drawings.

DETAILED DESCRIPTION OF THE PREFERRED EMBODIMENTS

Figure 1:
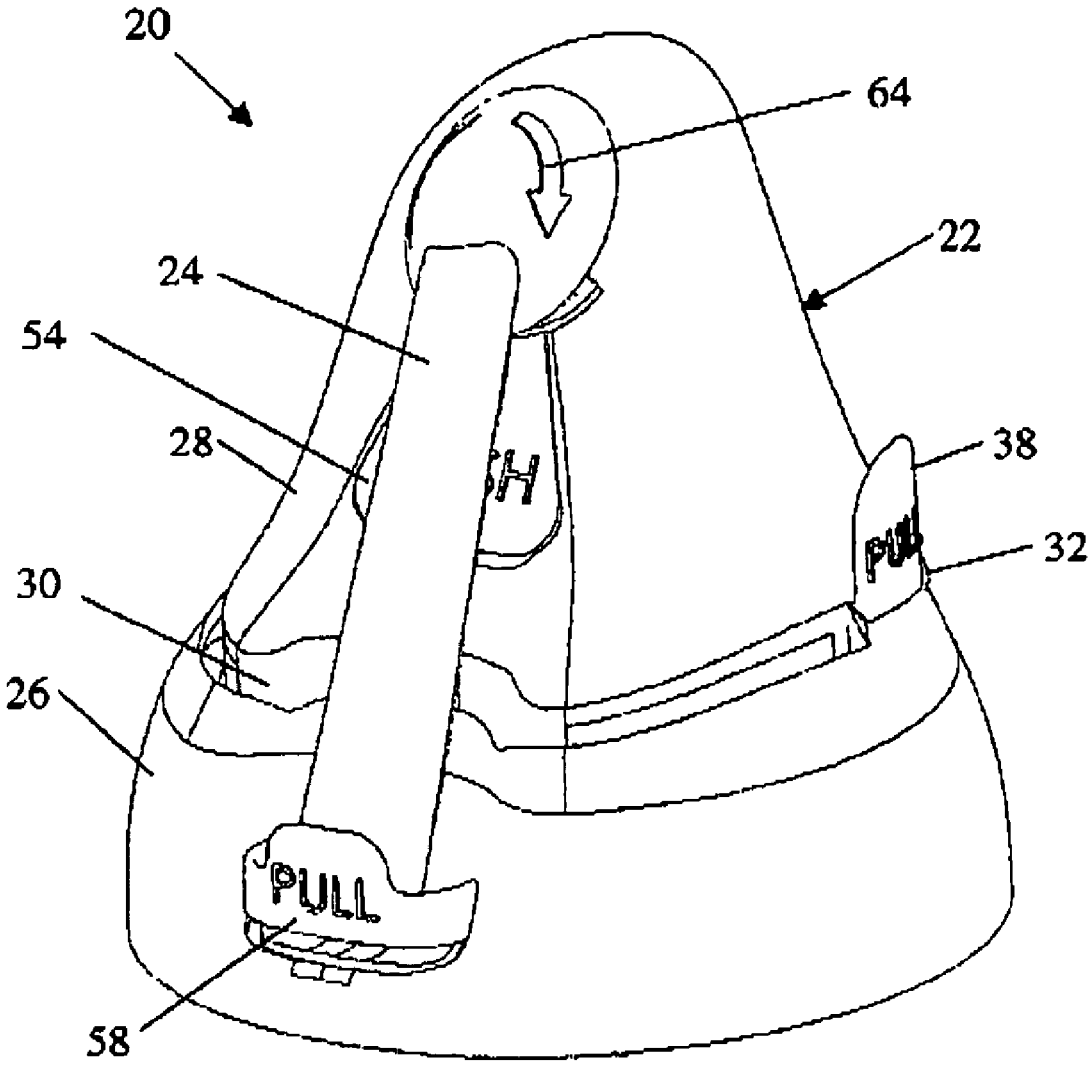
FIG. 1 is a perspective view of a preferred embodiment of a cap and dispenser tube assembly in a stowed position in accordance with the principles of this invention.
Figure 5:
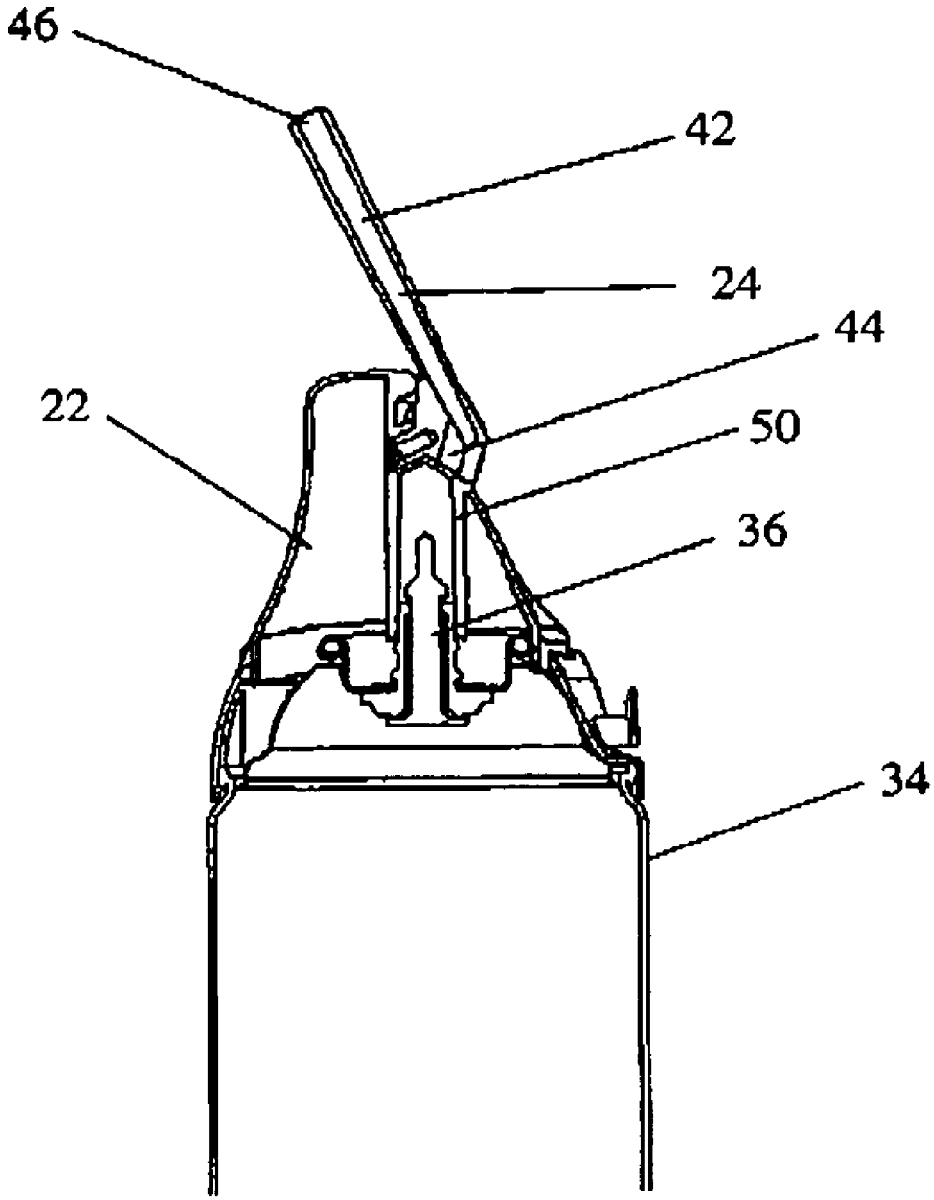
FIG. 5 is a partial vertical cross-sectional view of the cap as it would be mounted on a can in accordance with the principles of this invention.

A preferred embodiment of a dispenser constructed according to the principles of this invention is indicated generally as 20 in FIG. 1. The dispenser 20 comprises a cap 22 and a dispenser tube 24. The cap 22 has first or proximal section 24, a second or distal section 28 connected by a hinge portion 30 and by a removable portion 32. In the preferred embodiment, the first or proximal section 24 is adapted to snap fit onto the end of an aerosol container 34. over the aerosol dispensing valve 36 (see FIG. 5). The dispensing valve 36 is preferably a displacement actuated valve, but can be a push actuated valve, or any other type of dispensing valve. The interior of the cap 22 has a plurality of ribs 37 and ups 39 for engaging the rim of the container 34 The second section 26 of the cap 22 can move or pivot relative to the first section 24, to operate the valve 38 to discharge the contents of the container 34.

The removable portion 32 between the first section 24 and second section 26 restricts the movement of the second section 26 to resist operation of the dispensing valve 36 until the removable portion 32 is detached from the cap 22 by the end consumer. The removable portion 32 preferably comprises a strip, separated from the first and second sections by lines of weakness, which could be lines of reduced thickness or lines of perforation. The removable portion 32 of the cap 22 preferably further comprises a "Pull" tab 38 that may be pulled to facilitate detaching the removable portion 28 from the cap. The "Pull" tab 38 provides a convenient place for user directions on how to remove the removable portion (e.g. "PULL"), and it makes it easier for a user to grip, pull, and remove the removable portion 32.

Figure 2:
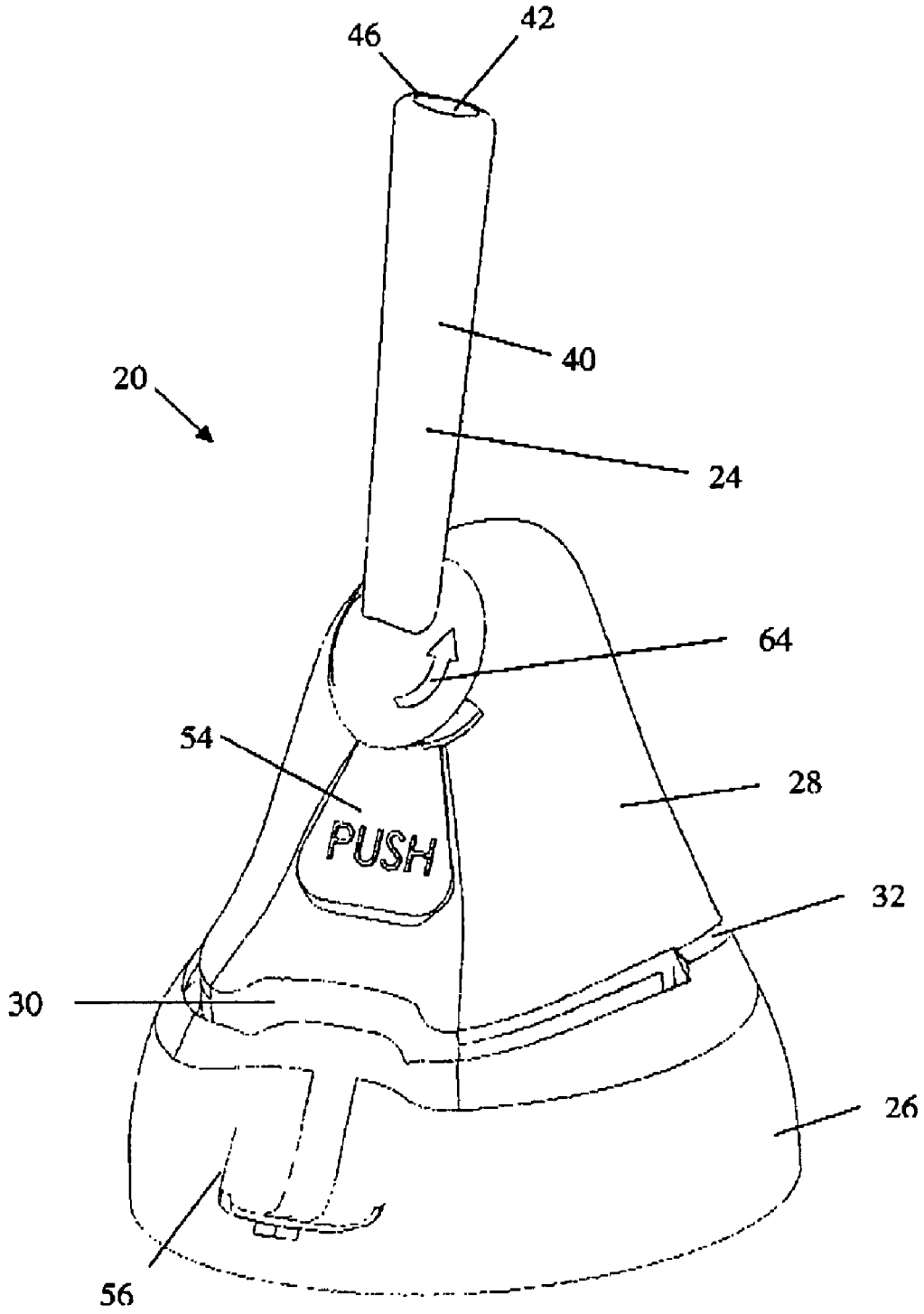
FIG. 2 is a perspective view of a cap and dispenser tube assembly in an open dispensing position in accordance with the principles of this invention.
Figure 4:
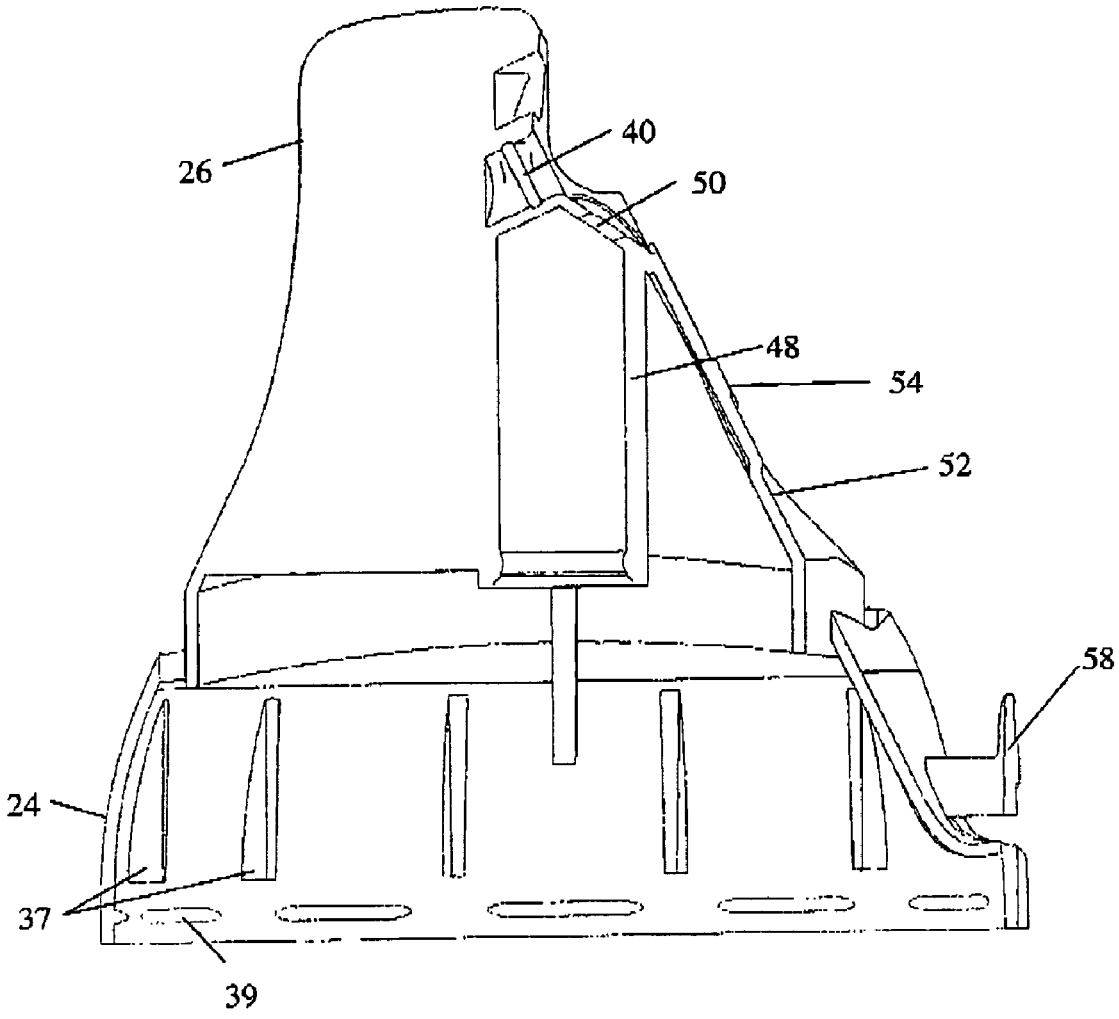
FIG. 4 is a cross-sectional view of a cap for an aerosol can in accordance with the principles of this invention.

The cap 22, and in particular the distal section 28 of the cap, has a generally cylindrical recess 40 (shown in FIG. 4) for receiving and pivotally mounting the dispenser tube 24 to pivot between a first stowed position as shown in FIG. 1, and a second dispensing position as shown in FIG. 2. The dispenser tube 24 comprises a passage 42, with a proximal end 44 opening near the proximal end of the dispenser tube, and a distal end 46 opening near the distal end of the dispenser tube.

The cap 22, and in particular the distal section 28, further comprises a sleeve 48 therein for receiving and substantially sealingly engaging the valve 36 on the can or container 34. A passage 50 extends through the distal section 28 in communication with the sleeve 48. When the dispenser tube 24 is pivoted to the dispensing position, the proximal end 44 of the passage 42 is aligned with, and communicates with, the passage 50 in the cap 22 (shown in FIG. 4).

The cap 22 preferably has a substantially flat face 52, oblique to the longitudinal axis of can. A "Push" tab 54 is preferably provided on the second or distal section 26 of the cap 22, and can be positioned on this face 52. The "Push" tab 54 is preferably sized and positioned so that the user can push on the "Push" tab to displace the second section 26 relative to the first proximal section 24 (after the removable portion 32 is detached), to operate the dispensing valve 36 to deliver the contents of the container 34 through the passage 42 in the dispenser tube 24. In the preferred embodiment, the container 34 contains a foam-forming liquid product, such as a whipped cream product. This product is particular suitable for frothing a beverage, such as coffee, to make a latte. However, the invention is not so limited and could be applied to the delivery of other food products, or even other non-food products, including food products such as whipped cream, cheese, and condiments, and non-food products such as caulk, plastic foams (such as urethane foams and latex foams), cleaners, waxes, polishes, cosmetics, skin lotions, sunscreen, sun blocks, and self tanners.

When pivoted to its dispensing position, the dispenser tube 24 projects or extends away from the cap 22, so that the distal end may be conveniently positioned adjacent to a surface or onto or into a liquid for enabling convenient delivery of the contents. When the dispenser tube 24 is pivoted to the stowed position, the dispenser tube 24 obscures the "Push" tab 54 on the cap, and is engaged by a catch 56 on the cap, to thereby resist movement or operation of the dispensing valve. Specifically, when the dispenser tube 24 is in the stowed position it restricts movement of the second or distal section 26 relative to the first proximal section 24 of the cap. In a position between the dispensing and stowed positions, the proximal and distal ends 44 and 46 of the dispenser tube passage 42 are both open to allow the passage to be conveniently flushed or rinsed clean.

The cap 22 can further comprise a tamper resistant removable "Pull" tab 58 for retaining the dispenser tube 24 in the stowed position prior to use by the end user or consumer. The removable tab 58 restricts pivoting movement of the dispenser tube 40 away from its initially stowed position, until the removable "Pull" tab 58 is detached by the end-use or consumer. The absence of the "Pull" tab 58 (like the absence of the removable portion 32) from the product serves as a tamper indicator.

Figure 3:
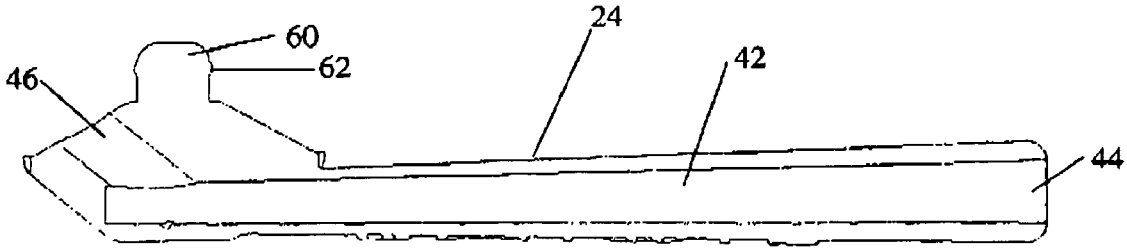
FIG. 3 is a cross-sectional view of the dispenser tube in accordance with the principles of this invention.

The dispensing tube 24 is preferably made from a polypropylene or other suitable polymeric material. Of course the dispensing tube could be made from any other suitable material compatible with the contents of the container the liquid it is to be dispensed to. As shown in FIG. 3, the dispenser tube 24 has a stud 60 adjacent its proximal end adapted to fit in a corresponding recess 40 in the cap (FIG. 54). The stud 60 has a circumferential ring 62 for engaging a shoulder in the recess 40 and thereby securing the stud 60 in the recess 40, while permitting the dispenser tube 24 to pivot.

The dispenser tube 24 is sufficiently long to project or extend a sufficient length for enabling the distal end 44 of the passage 42 to be placed in a liquid such that a foamed product may be delivered below the surface of the liquid through the tube. Instructional indicia, such as an instructional graphic of text message, can be provided on the dispenser tube 24. In the preferred embodiment, this instructional indicia includes a arrow graphic 64, illustrating the that direction of movement of the extension tube.

In accordance with the principles of this invention, the cap is preferably made from a polypropylene or other suitable polymeric material.

OPERATION

In operation the cap 22 is provided on an aerosol can 34 having an aerosol dispensing valve 36. The can 34 contains a charged of a fluid, and more preferably a foam-forming fluid, under pressure. Most preferably, the can 34 contains a cream or cream substitute.

In use, the consumer removes the removable portion 32, to allow the second section of the cap to pivot relative to the first portion. The user also removes the "Pull" tab 58. The dispenser is now ready for use. To dispense the contents of the can, the user simply pivots the tube 24 to its dispensing position, bringing the proximal end 44 of the passage 42 into alignment with the opening 50 in the cap, which in turn communicates with the passage 48 in which the valve 36 is disposed. The user positions the distal end of the tube 24 at the location where the contents are to be dispensed. The tube 24 allows the user to dispense the contents onto or into a liquid, and in particular into coffee or other beverage. The user presses on the tab 54, which causes the second portion of the cap to pivot on the hinge 30, operating the valve 36. The valve 36 discharges the contents of the can 34 into the sleeve 48, from where it passes through opening 50, and then into the proximal end 44 of the passage 42, and eventually out the distal end 46 of the passage 42.

After product has been dispensed, the user can pivot the tube 24 to a position intermediate the dispensing and stowed positions in which the proximal and distal ends 44 and 46 of the passage 42 are exposed, to wash out the passage. The tube 24 can then be operated to its stowed position, where it overlies the face 52, preferably obscuring the "Push" tab 54. In the preferred embodiment, the tube 24 engages the first portion 24 of the cap, so that it physically resists the pivoting of the second portion 26, and thus resists inadvertent operation of the dispenser.

Thus the dispenser 20 is capable of being extended to deliver a foamed product below the surface of a liquid, and is also capable of being positioned for enabling cleaning of the dispenser after use. The cap may further comprise a detent (not shown) to retaining the dispenser tube in the stowed position, to further improve restriction of operation of the dispensing valve.

Additional design considerations, readily apparent to one of ordinary skill in the art, such as the modification of the dispensing tube to include a detent for securing the tube in the stowed position, may also further improve restriction of movement and operation of the dispensing valve. It should be apparent to those skilled in the art that various modifications such as the above may be made without departing from the spirit and scope of the invention. More particularly, the dispenser may be adapted to any aerosol can or container for dispensing a variety of foamed products. Accordingly, it is not intended that the invention be limited by the particular form illustrated and described above, but by the appended claims.

What is claimed is:

1. An aerosol dispenser for delivering a substance, the dispenser comprising;

a can for holding a pressurized charge of the substance;

a valve for dispensing the substance;

a cap on the can covering the valve, the cap comprising a first section secured on the can and a second section hingedly mounted on the first section for movement relative to the first section;

an extension tube, having a proximal end and a distal end, and a passage therethrough the extension tube being pivotally mounted adjacent to the proximal end to the second section of the cap, to pivot between a stowed position, and a dispensing position in which the proximal end of the passage communicates with the valve; and the cap and valve being configured so that movement of the second section of the cap relative to the first section when the extension tube is in the dispensing position operates the valve to dispense the substance from the distal end of the extension tube, where the cap includes a removable portion between the first and second sections of the cap, which resists relative movement of the first and second sections, and thus operation of the valve.

2. The aerosol dispenser according to claim 1 wherein the removable portion is formed integrally with the first and second sections of the cap and is defined by lines of weakness between the removable portion and the first and second sections, respectively.

3. The aerosol dispenser according to claim 1 wherein when the extension member is the stowed position, the extension member resists relative movement of the first and second sections of the cap to thereby resist operation of the valve.

4. The aerosol dispenser according to claim 1 wherein when the extension tube is positioned between the dispensing and stowed positions, the first and second ends of the passage through the extension tube are open, and wherein in the dispensing position the first end of the passage communicates with the valve.

5. The aerosol dispenser according to claim 1 wherein the cap has a flat face oriented at an oblique angle with respect to the axis of the can, and wherein the extension tube is mounted to pivot between a stowed position in which the tube overlies the flat face and a dispensing position in which the distal end of the tube projects beyond the cap.

6. The aerosol dispenser according to claim 5 further comprising an instruction graphic for operating the dispenser on the flat face of the cap, which is obscured by the extension tube when the extension tube is in the stowed position.

7. The aerosol dispenser according to claim 6 further comprising a catch on the first section of the cap that engages the extension member when the extension member is in the stowed position, and resisting movement of the second section while the extension member is in the stowed position.

8. The aerosol dispenser according to claim 5 wherein the dispenser tube pivots about an axis perpendicular to the flat face.

9. An aerosol dispenser for delivering a substance, the dispenser comprising:

a can for holding a pressurized charge of the substance;

a valve for dispensing the substance;

a cap on the can covering the valve, the cap having a flat face oriented at an oblique angle with respect to the axis of the can, and a first section secured on the can and a second section hingedly mounted on the first section for movement relative to the first section;

an extension tube, having a proximal end and a distal end, and a passage therethrough the extension tube being pivotally mounted adjacent to the proximal end to the second section of the cap, to pivot between a stowed position, and a dispensing position in which the proximal end of the passage communicates with the valve; and the cap and valve being configured so that movement of the second section of the cap relative to the first section when the extension tube is in the dispensing position operates the valve to dispense the substance from the distal end of the extension tube, where the cap includes a catch on the first section of the cap that engages the extension member when the extension member is in the stowed position, and resisting movement of the second section while the extension member is in the stowed position.

10. An aerosol dispenser for delivering a substance, the dispenser comprising:

a can for holding a pressurized charge of the substance;

a valve for dispensing the substance;

a cap on the can covering the valve, the cap comprising a first section secured on the can and a second section hingedly mounted on the first section for movement relative to the first section;

an extension member, having a proximal end and a distal end, and a passage therethrough, the extension member being pivotally mounted adjacent to the proximal end to the second section of the cap, to pivot between a stowed position, and a dispensing position in which the proximal end of the passage communicates with the valve;

the cap and valve being configured so that movement of the second section of the cap relative to the first section when the extension tube is in the dispensing position operates the valve to dispense the substance from the distal end of the extension tube, wherein the cap includes a removable tab that secures the extension member in the stowed position.

11. The aerosol dispenser according to claim 10 further comprising a removable portion between the proximal and distal sections of the cap, which resists relative movement of the proximal and distal sections, and thus operation of the valve.

12. The aerosol dispenser according to claim 11 wherein the removable portion is formed integrally with the proximal and distal sections of the cap and is defined by lines of weakness between the removable portion and the proximal and distal sections, respectively.

13. The aerosol dispenser according to claim 10 wherein when the extension member is in the stowed position, the extension member resists relative movement of the proximal and distal sections of the cap to thereby resist operation of the valve.

14. The aerosol dispenser according to claim 10 wherein the cap has a flat face oriented at an oblique angle with respect to the axis of the can, and wherein the extension tube is mounted to pivot between a stowed position in which the tube overlies the flat face and a dispensing position in which the distal end of the tube projects beyond the cap.

15. The aerosol dispenser according to claim 14 further comprising an instruction graphic for operating the dispenser on the flat face of the cap, which is obscured by the extension tube when the extension tube is in the stowed position.

16. The aerosol dispenser according to claim 15 further comprising a catch on the proximal section of the cap that engages the extension member when the extension member is in the stowed position, and resisting movement of the distal section while the extension member is in the stowed position.

17. The aerosol dispenser according to claim 14 further comprising a catch on the proximal section of the cap that engages the extension member when the extension member is in the stowed position, and resisting movement of the distal section while the extension member is in the stowed position.

18. The aerosol dispenser according to claim 14 wherein the dispenser tube pivots about an axis perpendicular to the flat face.

19. An aerosol dispenser for delivering a substance the dispenser comprising:

a can for holding a pressurized charge of a substance;

a valve for dispensing the a substance;

a cap on the can covering the valve, the can having a generally tapering configuration comprising a proximal section secured on the can and a distal section hingedly connected to the proximal section for movement relative to the first section;

an extension tube, having a proximal end and a distal end, and a passage therethrough the extension tube being pivotally mounted adjacent to the proximal end to the distal section of the cag, to pivot between a stowed position, and a dispensing position in which the proximal end of the passage communicates with the valve; and the cap and valve being configured so that movement of the distal section of the cap relative to the proximal section when the extension tube is in the dispensing position operates the valve to dispense the substance from the distal end of the extension tube, wherein when the extension tube is positioned between the dispensing and stowed positions, the first and second ends of the passage through the extension tube are open, and wherein when the extension tube is positioned in the dispensing position the first end of the passage communicates with the valve.

20. An improved aerosol dispenser having a distal end for dispensing a substance, the improvement comprising:

a container for holding a pressurized charge of the substance;

a valve for dispensing the substance;

a cap on the container covering the valve, the cap comprising a first section secured to the container, a second section, and a removable portion between the first and second sections, wherein the second section is free to move relative to the first section when the removable portion is detached from the cap;

an extension tube having a proximal end and a distal end and a passage therein, the extension tube being pivotally mounted adjacent to the proximal end to the second section of the cap in a manner such that the extension tube pivots between a stowed position and a dispensing position in which the proximal end of the passage communicates with the valve; and the cap and valve being configured so that movement of the second section of the cap relative to the first section when the extension tube is in the dispensing position operates the valve to dispense the substance from the distal end of the extension tube, wherein the removable portion of the cap resists movement of the second section relative to the first section, and thus operation of the valve.

21. The improved aerosol dispenser of claim 20, wherein the removable portion of the cap further comprises a removable pull tab to facilitate detaching of the removable portion.

22. The improved aerosol dispenser of claim 21, further comprising a second removable pull tab, wherein the second removable pull tab restricts pivoting movement of the extension tube from a stowed position to provide a tamper evident cap for the product.

23. The improved aerosol dispenser of claim 22, wherein when the extension tube is pivoted to a position between the dispensing and stowed positions, the proximal and distal ends of the passage through the extension tube are open to allow for cleaning of the passage.

* * * * *